US008197195B2

(12) United States Patent
Lombard et al.

(10) Patent No.: US 8,197,195 B2
(45) Date of Patent: Jun. 12, 2012

(54) TURBOCHARGER WITH STEPPED TWO-STAGE VANE NOZZLE

(75) Inventors: Alain R. Lombard, Uxegney (FR); Sebastian Ferrari, Thaon les Voges (FR); Laurent Vautier, Tendon (FR); Valerie Bribant, Golbey (FR)

(73) Assignee: Honeywell International Inc., Morristown, NJ (US)

( * ) Notice: Subject to any disclaimer, the term of this patent is extended or adjusted under 35 U.S.C. 154(b) by 1039 days.

(21) Appl. No.: 12/093,648

(22) PCT Filed: Nov. 16, 2005

(86) PCT No.: PCT/US2005/041362

§ 371 (c)(1),
(2), (4) Date: May 14, 2008

(87) PCT Pub. No.: WO2007/058649

PCT Pub. Date: May 24, 2007

(65) Prior Publication Data

US 2008/0317593 A1 Dec. 25, 2008

(51) Int. Cl.
*F01D 17/16* (2006.01)

(52) U.S. Cl. ..... 415/158; 415/186; 415/191; 415/208.3; 415/211.1

(58) Field of Classification Search ..... 415/146, 415/147, 157, 158, 151, 186, 191, 208.1, 415/208.2, 208.3, 211.1
See application file for complete search history.

(56) References Cited

U.S. PATENT DOCUMENTS

| | | | | |
|---|---|---|---|---|
| 2,861,774 | A * | 11/1958 | Buchi | 415/17 |
| 4,586,336 | A | 5/1986 | Horler | |
| 4,643,639 | A | 2/1987 | Caine | |
| 5,441,383 | A | 8/1995 | Dale et al. | |
| 6,536,214 | B2 * | 3/2003 | Finger et al. | 60/602 |
| 6,652,224 | B2 * | 11/2003 | Mulloy et al. | 415/158 |
| 6,928,816 | B2 | 8/2005 | Leavseley | |
| 2004/0244372 | A1 * | 12/2004 | Leavesley | 417/407 |

FOREIGN PATENT DOCUMENTS

| | | |
|---|---|---|
| EP | 1353040 | 1/2003 |
| WO | 02/06636 | 1/2002 |
| WO | 2005/106212 | 11/2005 |

OTHER PUBLICATIONS

PCT ISR/WO Honeywell.

* cited by examiner

*Primary Examiner* — Igor Kershteyn
(74) *Attorney, Agent, or Firm* — Alston & Bird LLP

(57) ABSTRACT

A turbocharger having a variable nozzle with stepped two-stage vanes (50), the variable nozzle comprising a tubular piston (70) disposed in the bore (44) of the turbine housing (38) such that the piston (70) is axially slidable adjacent to the vanes (50) that extend across the nozzle. Each vane defines a first vane stage (50*a*) proximate the free end of the vane, the second vane stage (50*b*) having a different aerodynamic contour in comparison with the first vane stage (50*a*), each vane comprising a step (60) transitioning from the first vane stage (50*a*) to the second vane stage (50*b*). The piston (70) in a closed position closes the second vane stage (50*b*) so that exhaust gas flows only through the first vane stage (50*a*). The second vane stage (50*b*) is progressively opened as the piston (70) is axially slid toward an open position.

13 Claims, 9 Drawing Sheets

TURBOCHARGER WITH STEPPED TWO-STAGE VANE NOZZLE

BACKGROUND OF THE INVENTION

The present invention relates generally to turbochargers, and relates more particularly to exhaust gas-driven turbochargers having an axially sliding piston for varying the size of a nozzle that leads into the turbine wheel so as to regulate flow into the turbine wheel.

Regulation of the exhaust gas flow through the turbine of an exhaust gas-driven turbocharger provides known operational advantages in terms of improved ability to control the amount of boost delivered by the turbocharger to the associated internal combustion engine. The regulation of exhaust gas flow is accomplished by incorporating variable geometry into the nozzle that leads into the turbine wheel. By varying the size of the nozzle flow area, the flow into the turbine wheel can be regulated, thereby regulating the overall boost provided by the turbocharger's compressor.

Variable-geometry nozzles for turbochargers generally fall into two main categories: variable-vane nozzles, and sliding-piston nozzles. Vanes are often included in the turbine nozzle for directing the exhaust gas into the turbine in an advantageous direction. Typically a row of circumferentially spaced vanes extend axially across the nozzle. Exhaust gas from a chamber surrounding the turbine wheel flows generally radially inwardly through passages between the vanes, and the vanes turn the flow to direct the flow in a desired direction into the turbine wheel. In a variable-vane nozzle, the vanes are rotatable about their axes to vary the angle at which the vanes are set, thereby varying the flow area of the passages between the vanes.

In the sliding-piston type of nozzle, the nozzle may also include vanes, but the vanes are fixed in position. Variation of the nozzle flow area is accomplished by an axially sliding piston that slides in a bore in the turbine housing. The piston is tubular and is located just radially inwardly of the nozzle. Axial movement of the piston is effective to vary the axial extent of the nozzle opening leading into the turbine wheel. When vanes are included in the nozzle, the piston can slide adjacent to radially inner (i.e., trailing) edges of the vanes; alternatively, the piston and vanes can overlap in the radial direction and the piston can include slots for receiving at least a portion of the vanes as the piston is slid axially to adjust the nozzle opening.

One of the design challenges with such sliding piston-type nozzles is to optimize the aerodynamics of the exhaust gas flow into the turbine wheel over the full stroke of the piston. In some sliding piston-type variable nozzles, flow disturbance can occur particularly in the beginning of piston stroke as the piston begins to move from its closed position toward a more-open position. More particularly, as the piston begins to open even a very small amount, the flow rate into the turbine can suddenly increase, making it difficult to regulate the piston stroke with sufficient accuracy to prevent a sudden flow surge.

BRIEF SUMMARY OF THE INVENTION

The present invention addresses the above needs and achieves other advantages, by providing a turbocharger having a sliding piston-type variable nozzle in which stepped two-stage vanes are employed. In accordance with one embodiment of the invention, the turbocharger includes a turbine wheel disposed in a bore of a turbine housing, the turbine housing defining a chamber surrounding the turbine wheel for receiving exhaust gas to be directed into the turbine wheel, a radially inner side of the chamber having an axial length. The turbocharger further comprising a variable nozzle having stepped two-stage vanes, the variable nozzle comprising a tubular piston disposed in the bore of the turbine housing such that the piston is axially slidable relative to the turbine housing along the radially inner side of the chamber such that the piston blocks a variable portion of the axial length of the chamber depending on axial position of the piston, the piston having an upstream end and a downstream end with respect to a flow direction of exhaust gas along the bore of the turbine housing. A generally annular wall extends generally radially inwardly adjacent an upstream end of the axial length of the chamber, and an array of circumferentially spaced vanes have fixed ends joined to the generally annular wall and opposite free ends, the vanes extending across the axial length of the chamber. Each of the vanes has an outer surface that faces generally radially outwardly and an opposite inner surface that faces generally radially inwardly. Each vane defines a first vane stage proximate the fixed end of the vane and a second vane stage proximate the free end of the vane, the second vane stage having a different aerodynamic contour of at least one of the outer and inner surfaces in comparison with the first vane stage, each vane comprising a step transitioning from the first vane stage to the second vane stage. The piston in a closed position closes the second vane stage so that exhaust gas flows only through the first vane stage. The second vane stage is progressively opened as the piston is axially slid toward an open position.

In accordance with the invention, the first vane stage can be aerodynamically tailored to optimize turbocharger performance at low engine speeds where the exhaust gas flow rate is relatively low. The second vane stage can be designed to optimize turbocharger performance at higher engine speeds where exhaust gas flow rates are substantially greater. The stepped two-stage vane design thus provides a greater degree of design flexibility.

In one embodiment of the invention, the step in each vane defines a downstream-facing surface that is abutted by the piston to define the closed position of the piston. The step can be defined in the outer surface of each vane, and the upstream end of the piston can have a radially inner surface that travels adjacent to the outer surfaces of the second vane stages as the piston is axially slid. Thus, the second vane stages are received into the central passage of the tubular piston as the piston moves toward the closed position.

Alternatively, the step can be defined in the inner surface of each vane, and the upstream end of the piston can have a radially outer surface that travels adjacent to the inner surfaces of the second vane stages as the piston is axially slid. In this variation, the piston is smaller in diameter than the vane array and the second vane stages reside adjacent the radially outer surface of the piston as the piston moves toward the closed position.

In another embodiment, the step is in the outer surface of each vane, and the upstream end of the piston has a radially outer surface in which recesses are formed for respectively receiving the second vane stages with the inner surface of each second vane stage confronting a radially outwardly facing wall of each respective recess. The free ends of the vanes abut end walls of the recesses to define the closed position of the piston. The engagement of the second vane stages in the recesses of the piston serves to prevent rotation of the piston.

According to a further embodiment, the upstream end of the piston has a radial wall thickness exceeding a radial extent of the second vane stages, and the piston defines slots extending into the upstream end of the piston for receiving the second vane stages. The step in the vanes can abut the end of the piston to define the closed position of the piston. The step can be in the outer surface of each vane, or alternatively the step can be in the inner surface or in both the outer and inner surfaces.

In yet another embodiment of the invention, the upstream end of the piston defines a radially outwardly extending flange, the flange defining apertures therethrough for receiving the second vane stages. The flange can abut the step in the vanes to define the closed position of the piston. The step can be defined in both outer and inner surfaces of the vanes, or alternatively can be in one or the other of the surfaces.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 2:
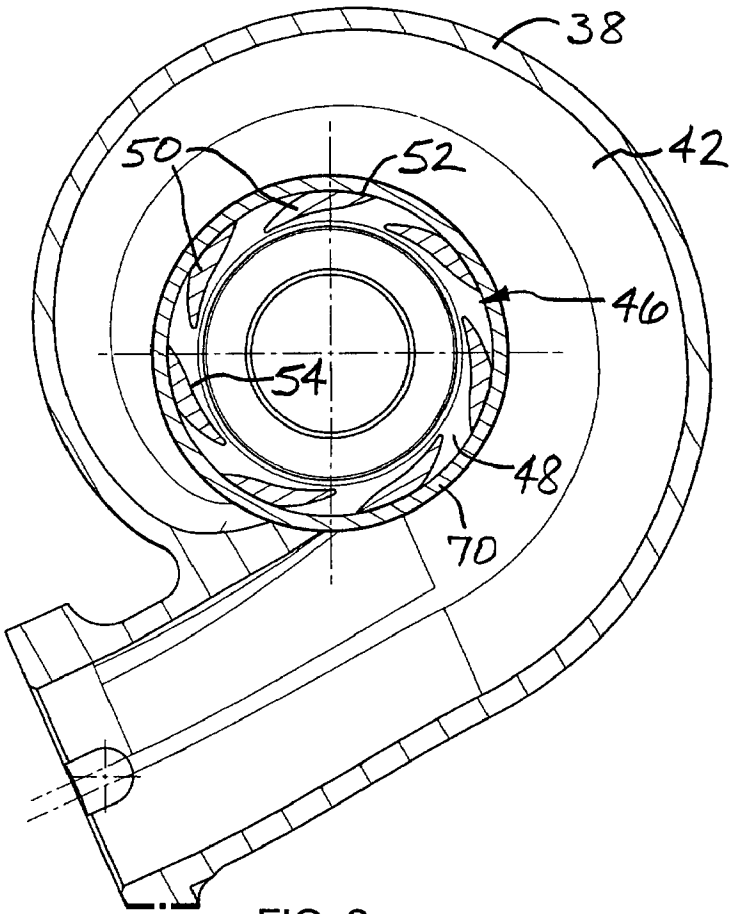
FIG. 2 is a cross-sectional view along line 2-2 in FIG. 1.
Figure 1:
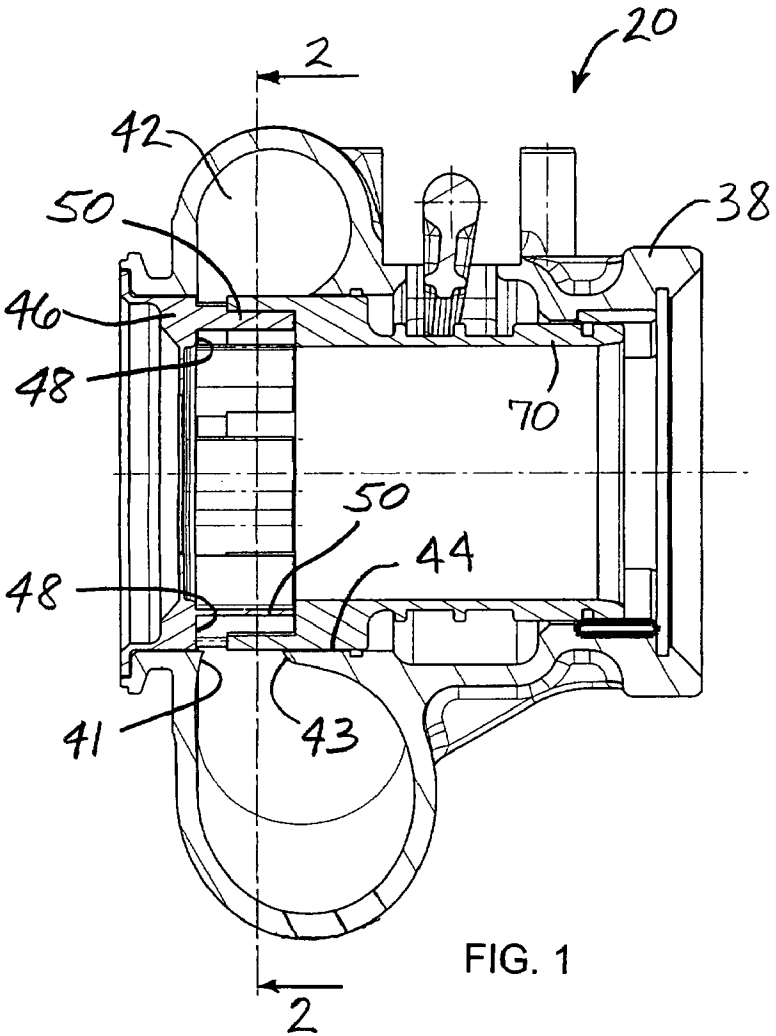
FIG. 1 is a cross-sectional view of a turbine assembly for a turbocharger, in accordance with a first embodiment of the invention, showing the piston in a closed position.
Figure 4:
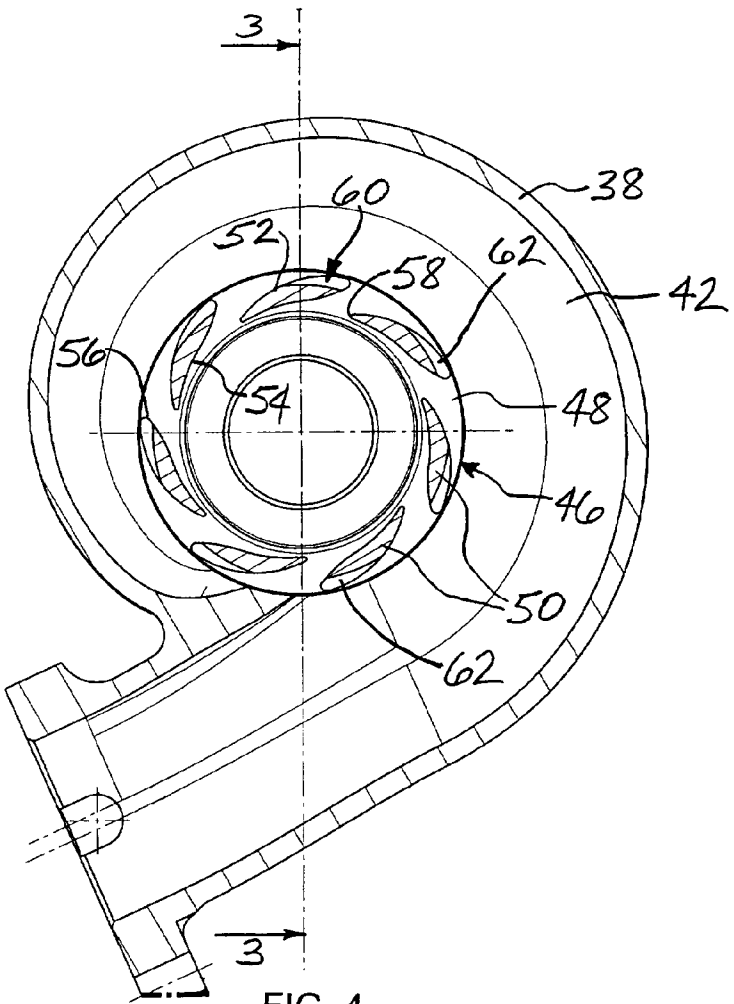
FIG. 4 is a cross-sectional view along line 4-4 in FIG. 3.
Figure 3:
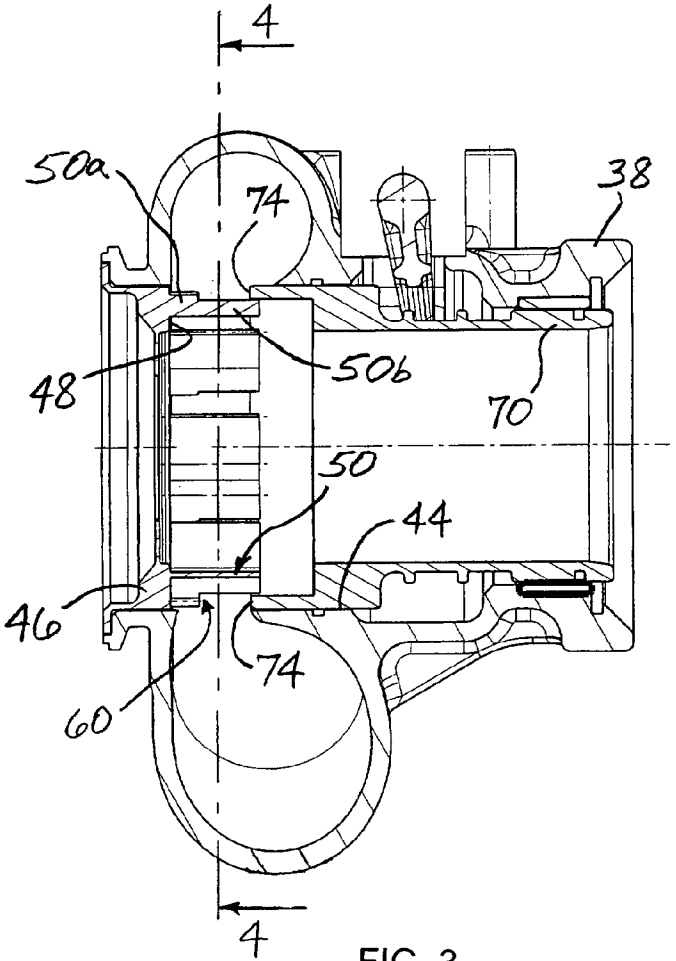
FIG. 3 is a view similar to FIG. 1, showing the piston in an open position.
Figure 6:
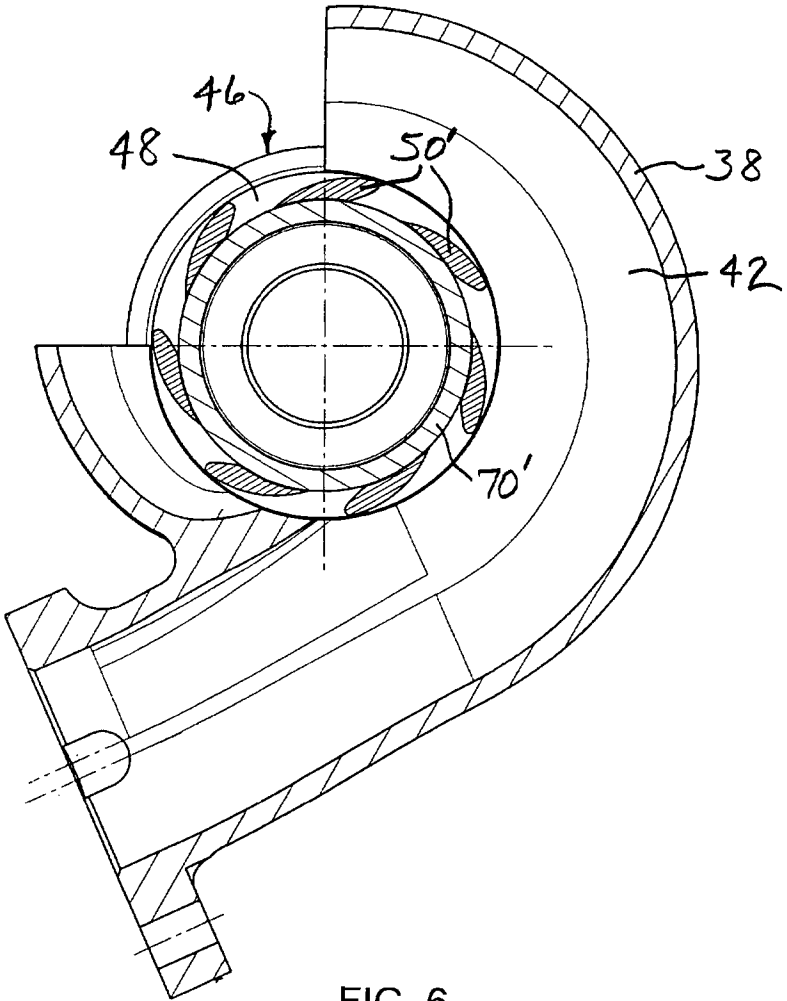
FIG. 6 is a cross-sectional view along line 6-6 in FIG. 5.
Figure 5:
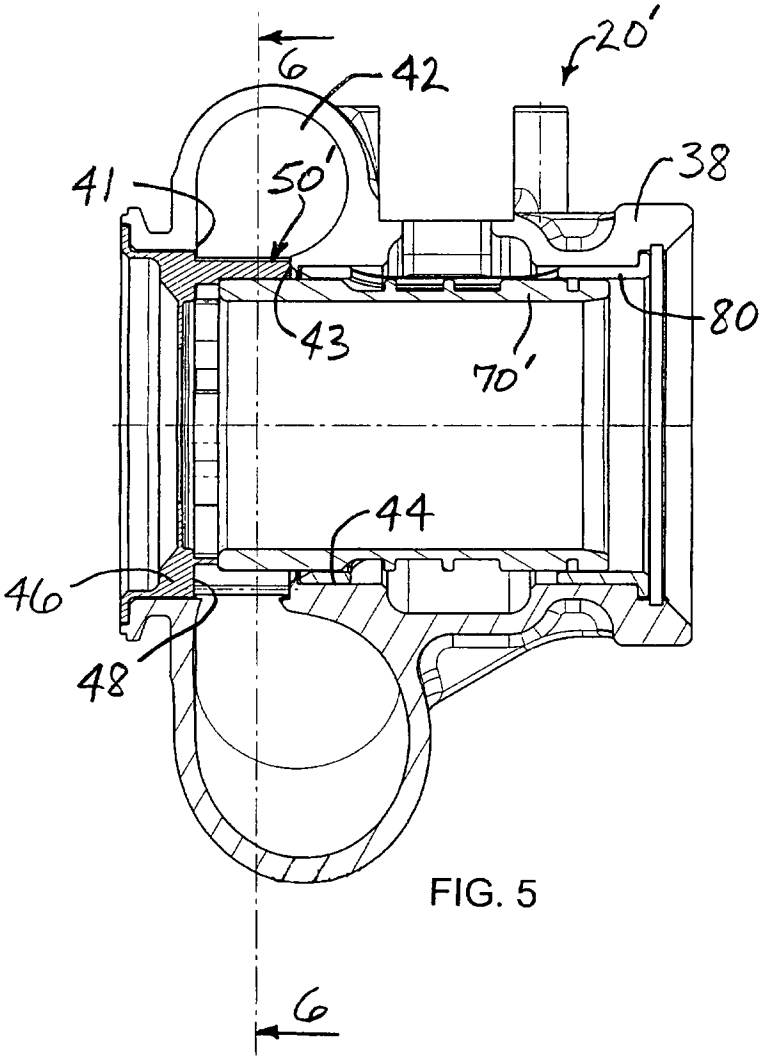
FIG. 5 is a cross-sectional view of a turbine assembly for a turbocharger, in accordance with a second embodiment of the invention, showing the piston in a closed position.
Figure 8:
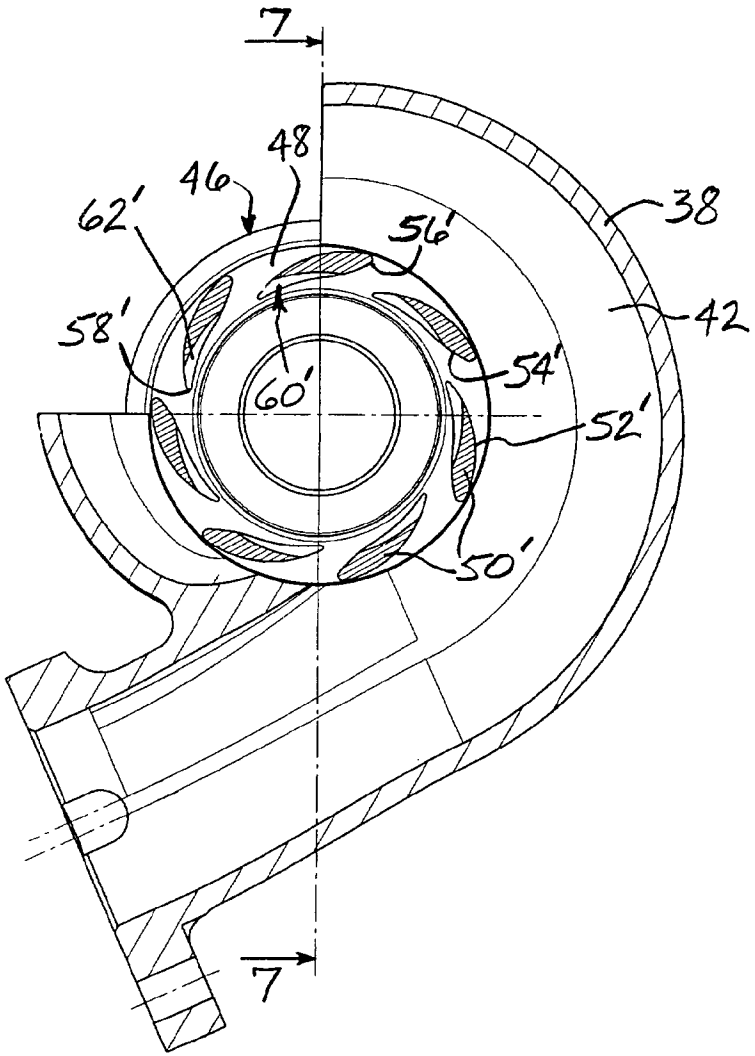
FIG. 8 is a cross-sectional view along line 8-8 in FIG. 7.
Figure 7:
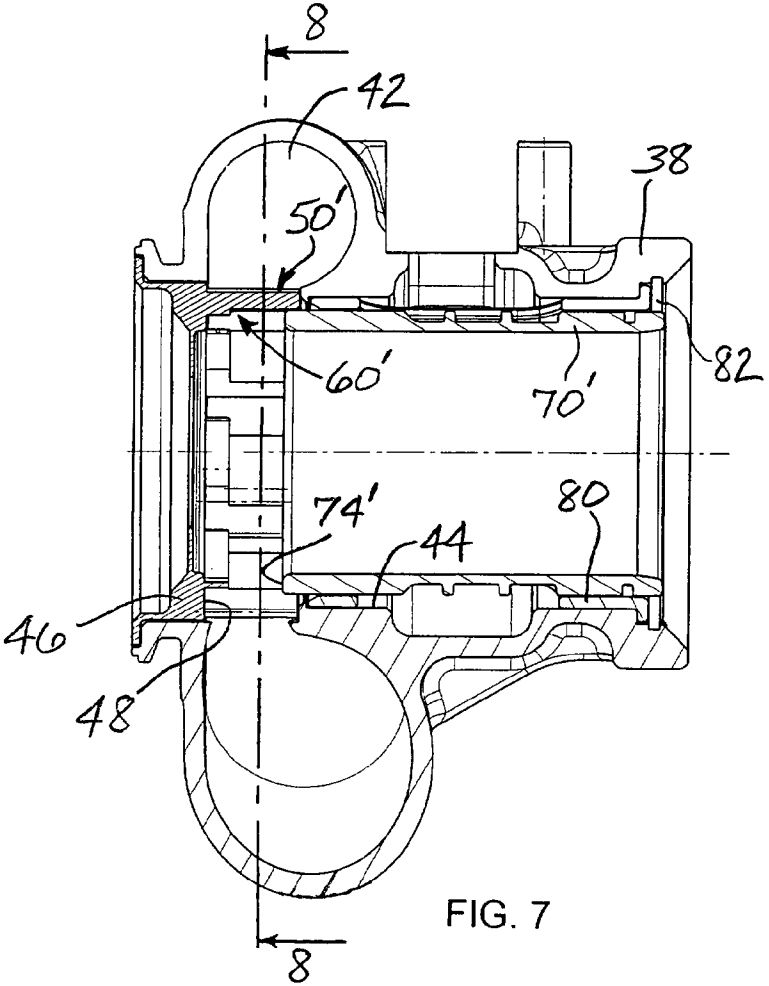
FIG. 7 is a view similar to FIG. 5, showing the piston in an open position.
Figure 10:
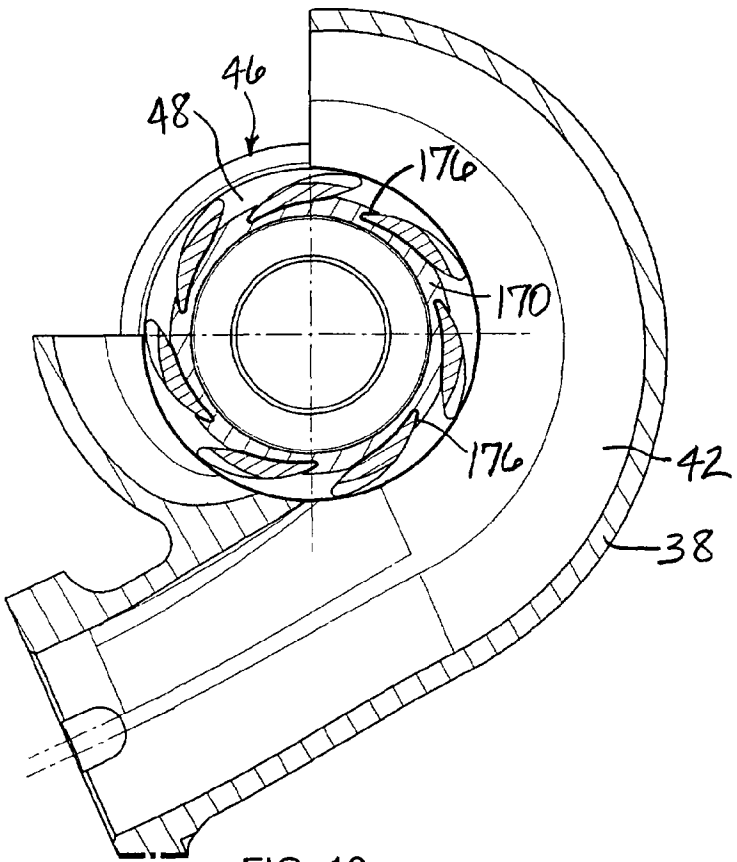
FIG. 10 is a cross-sectional view along line 10-10 in FIG. 9.
Figure 9:
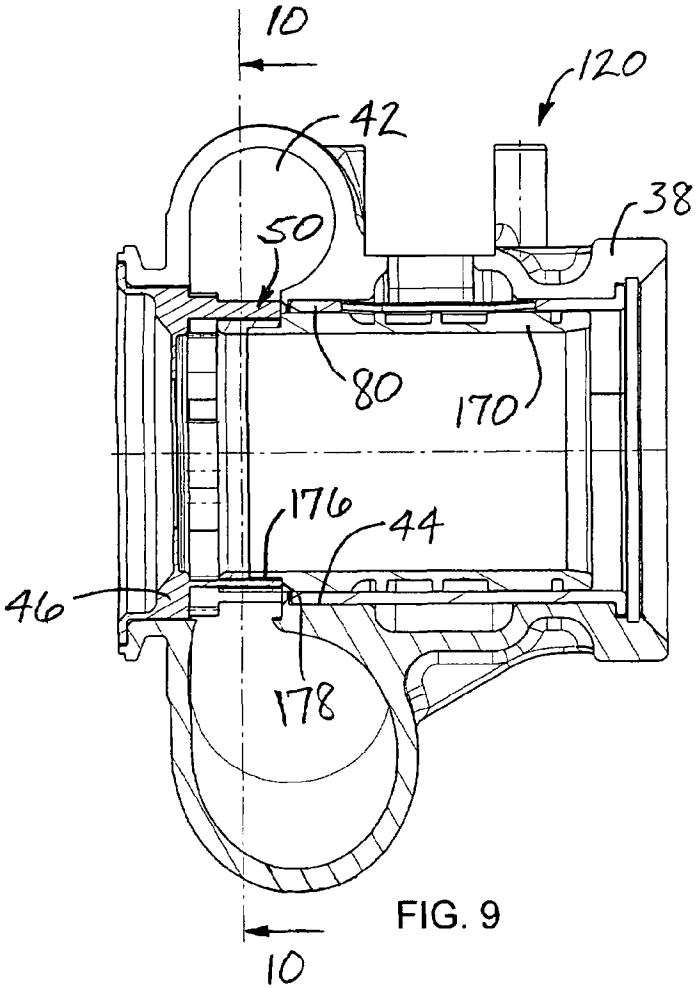
FIG. 9 is a cross-sectional view of a turbine assembly for a turbocharger, in accordance with a third embodiment of the invention, showing the piston in a closed position.
Figure 12:
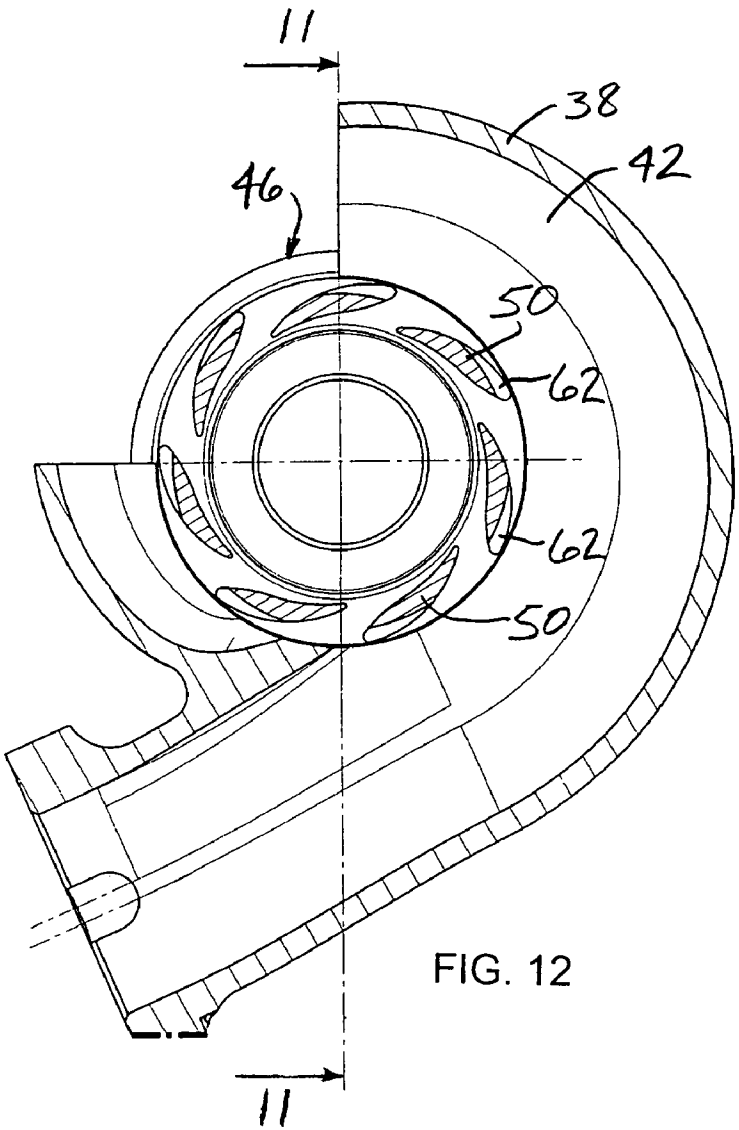
FIG. 12 is a cross-sectional view along line 12-12 in FIG. 11.
Figure 11:
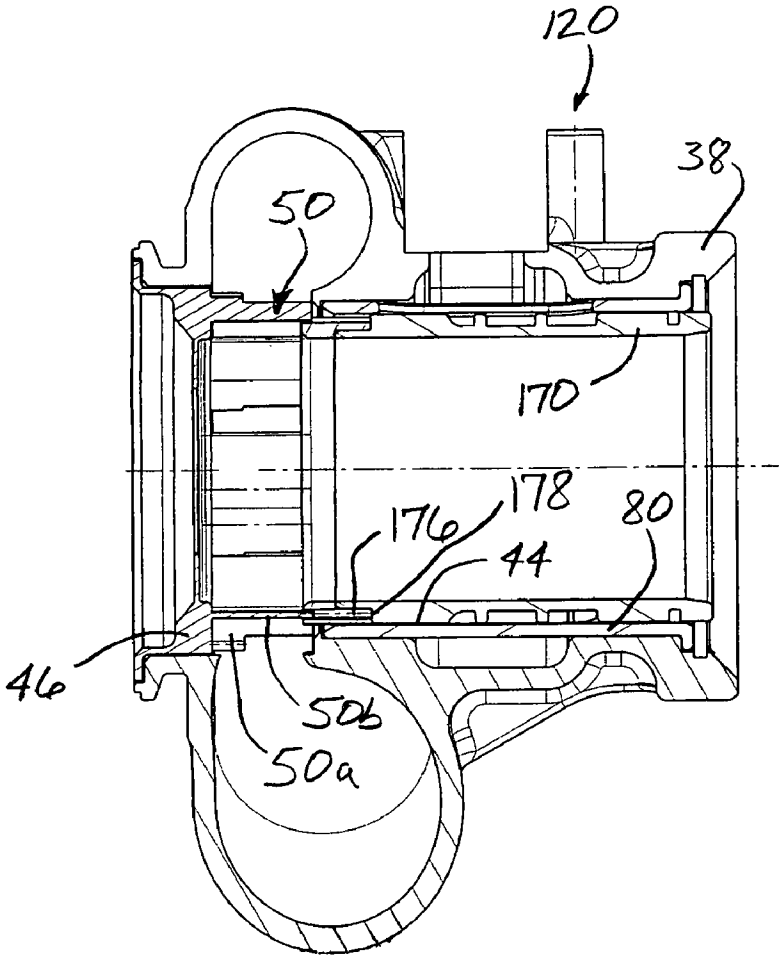
FIG. 11 is a view similar to FIG. 9, showing the piston in an open position.

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1 through 4 illustrate a turbine assembly 20 for a turbocharger, having a sliding piston-type variable nozzle in accordance with a first embodiment of the invention. The turbine assembly includes a turbine housing 38 adapted to be coupled to a center housing (not shown) of the turbocharger. A turbine wheel (not shown) is mounted on an end of a rotatable shaft (not shown) of the turbocharger and is disposed in the turbine housing. The turbine housing defines a chamber 42 that surrounds the turbine wheel and receives exhaust gas from the internal combustion engine. Exhaust gas is directed from the chamber 42 into the turbine wheel, which expands the exhaust gas and is driven thereby so as to drive a compressor wheel (not shown) mounted on the opposite end of the shaft. The chamber 42 at its radially inner side has an axial extent, defined between opposite walls 41, 43 of the chamber, that generally corresponds to an axial extent of the blades of the turbine wheel, although in some cases it may be desirable for the axial extent of the chamber to be somewhat greater than that of the turbine blades to allow for the possibility of some proportion of exhaust gas flow to bypass the turbine blades, as further described below. The opening defined between the walls 41, 43 of the chamber makes up part of what is referred to herein as the turbine nozzle.

The turbine housing 38 defines a bore 44 whose diameter generally corresponds to a radially innermost extent of the chamber 42. The turbine wheel resides in an upstream end of the bore 44 and the turbine wheel's rotational axis is substantially coaxial with the bore. The term "upstream" in this context refers to the direction of exhaust gas flow through the bore 44, as the exhaust gas in the chamber 42 flows into the turbine wheel and is then turned to flow generally axially (left to right in FIG. 1) through the bore 44 to its downstream end. Thus, "upstream" is to the left and "downstream" is to the right in FIG. 1.

The turbocharger 20 includes a heat shield 46 that is mounted between the turbine housing 38 and the center housing and provides a barrier substantially preventing hot exhaust gas from infiltrating or excessively heating up the bearing area in the center housing. The heat shield comprises a generally annular wall 48 that extends generally radially inwardly from, and essentially serves as an extension of, the wall 41 of the turbine housing chamber 42, adjacent an upstream end of the turbine wheel. Axially projecting from the wall 48 is an array of circumferentially spaced vanes 50. The vanes have fixed ends joined to the wall 48, and opposite free ends. The length of the vanes from the wall 48 to the free ends of the vanes substantially corresponds to the axial length defined between the walls 41, 43 of the turbine housing chamber at its radially inner side. Thus, the vanes 50 extend substantially all the way across the opening between the walls 41, 43, and the free ends of the vanes can abut the wall 43 if desired. Alternatively, however, the vanes could be shorter than the axial length of the chamber opening.

Each vane 50 comprises a stepped vane. More specifically, with particular reference to FIGS. 3 and 4, each vane has an outer surface 52 that faces generally radially outwardly, and an inner surface 54 that faces generally radially inwardly. Each vane has a leading edge 56 and a trailing edge 58 with respect to a direction of flow of exhaust gas through the spaces defined between adjacent vanes. The outer surface 52 of each vane has a step 60 that extends from the leading edge 56 partway toward the trailing edge 58. The step 60 has its maximum height at the leading edge 56 and gradually diminishes in height with distance along the vane toward the trailing edge 58 until the step vanishes. The step 60 divides the vane into two portions: a first vane stage 50*a* that extends from the fixed end of the vane at the wall 48 up to the step 60; and a second vane stage 50*b* that extends from the step 60 to the free end of the vane. The step 60 creates an axially facing surface 62 that faces generally toward the turbine chamber wall 43. As further described below, the surfaces 62 of the stepped vanes serve as a stop for an axially sliding piston of the variable nozzle mechanism.

The turbine assembly 20 further comprises an axially sliding piston 70 of tubular form. The piston is disposed within the bore 44 of the turbine housing and is axially slidable in the bore. At least one sealing ring is disposed in a groove in the radially outer surface of the piston for engaging the inner surface of the bore 44 to provide sealing between the piston and bore so that exhaust gas cannot escape between these parts. The piston is slidable between a closed position (FIG. 1) and an open position (FIG. 3), and various intermediate positions therebetween. The inner diameter of at least the upstream end portion of the piston that axially overlaps the second vane stage 50*b* is slightly greater than the maximum diameter of the second vane stage. The piston's radially inner surface travels adjacent to the outer surfaces 52 of the second vane stages 50*b* as the piston is axially slid. In the closed position of the piston, an upstream end surface 74 of the piston abuts the stop surfaces 62 of the stepped vanes. In this position, the piston effectively blocks the entire second vane stage 50*b* so that exhaust gas is prevented from flowing through the second vane stage to the turbine wheel. Accordingly, apart from a very small amount of leakage of exhaust gas that may occur between the stop surfaces 62 and the piston end surface 74 and then through the second vane stages 50*b*, substantially all of the exhaust gas that enters the turbine wheel flows through the first vane stage 50*a* when the piston is closed.

In the open position (FIG. 3) of the piston 70, the upstream end surface 74 can be generally in axial alignment with the wall 43 of the turbine housing chamber, or can be somewhat upstream of or downstream of the wall 43. When the piston is axially slid in the downstream direction starting from the closed position, the end surface 74 of the piston separates from the stop surfaces 62 of the stepped vanes, and accordingly exhaust gas begins to flow through the unblocked portion of the second vane stage 50*b*. With further travel of the piston, more and more of the second vane stage is unblocked so that a greater and greater proportion of the total exhaust gas flow passes through the second vane stage. When the piston reaches the open (i.e., fully open) position, preferably the entire length of the second vane stage is unblocked.

In accordance with the invention, the first vane stage 50*a* has a different aerodynamic contour than the second vane stage 50*b*. The first vane stage can be optimized for low engine speeds where exhaust gas flow rates are relatively low. The second vane stage can be optimized for higher engine speeds where exhaust gas flow rates are higher.

The presence of the second vane stage 50*b*, in comparison with having no vanes at all in the second nozzle portion, allows a smoother turbine flow rate evolution as the piston just begins to open from its fully closed position. With no vanes present, the turbine flow rate tends to suddenly increase when the piston just begins to open. This makes it difficult to regulate the piston stroke with sufficient accuracy to prevent a sudden flow surge. The result can be poor vehicle behavior as the degree of turbocharging provided to the engine suddenly increases. The presence of the second vane stage 50*b* helps prevent such sudden flow surge. Additionally, as noted, the second vane stage can have a different aerodynamic contour compared to the first vane stage. This allows an optimization of the vane incidence and the flow angle exiting the vanes into the turbine stage for each of the first and second vane stages, thereby enhancing design flexibility.

FIGS. 5 through 8 illustrate a turbine assembly 20' of a turbocharger in accordance with a second embodiment of the invention. The turbine assembly 20' is generally similar to the turbine assembly 20 described above. The turbine assembly 20' includes a turbine housing 38 defining a chamber 42 and having a bore 44 generally as in the prior embodiment. A heat shield 46 is mounted between the turbine housing 38 and the center housing (not shown) and defines a generally annular wall 48 as in the prior embodiment. An array of circumferentially spaced stepped two-stage vanes 50' are joined to the wall 48 and project axially therefrom across the radially inner side of the chamber 42, with free ends of the vanes closely adjacent or abutting the wall 43 of the chamber.

Each vane has an outer surface 52' that faces generally radially outwardly, and an inner surface 54' that faces generally radially inwardly. Each vane has a leading edge 56' and a trailing edge 58' with respect to a direction of flow of exhaust gas through the spaces defined between adjacent vanes. The inner surface 54' of each vane has a step 60' that extends from the trailing edge 58' partway toward the leading edge 56'. The step 60' has its maximum height at the trailing edge 58' and gradually diminishes in height with distance along the vane toward the leading edge 56' until the step vanishes. The step 60' divides the vane into two portions: a first vane stage 50*a*' that extends from the fixed end of the vane at the wall 48 up to the step 60'; and a second vane stage 50*b*' that extends from the step 60' to the free end of the vane. The step 60' creates an axially facing surface 62' that faces generally toward the turbine chamber wall 43. As further described below, the surfaces 62' of the stepped vanes serve as a stop for an axially sliding piston of the variable nozzle mechanism.

The variable nozzle mechanism further comprises an axially sliding piston 70' of tubular form. The mechanism also includes a carrier 80 of tubular form that is axially inserted into the bore 44 of the turbine housing and retained in a fixed position therein by a suitable retaining mechanism such as a snap ring 82 or the like. The carrier 80 defines a central bore within which the piston is received such that the piston is axially slidable relative to the carrier. At least one sealing ring is disposed in a groove in the radially outer surface of the piston for engaging the inner surface of the carrier 80 to provide sealing between the piston and carrier so that exhaust gas cannot escape between these parts. The carrier advantageously can be split along an axial line so that the carrier can radially expand and contract along with the piston so as to prevent binding or excessive clearance therebetween. The piston is slidable between a closed position and an open position, and various intermediate positions therebetween. The outer diameter of at least the upstream end portion of the piston that axially overlaps the second vane stage 50*b*' is slightly smaller than the minimum diameter of the second vane stage. The piston's radially outer surface travels adjacent to the inner surfaces 54' of the second vane stages 50*b*' as the piston is axially slid In the closed position of the piston, an upstream end surface 74' of the piston abuts the stop surfaces 62' of the stepped vanes. In this position, the piston effectively blocks the entire second vane stage 50*b*' so that exhaust gas is prevented from flowing through the second vane stage to the turbine wheel. Accordingly, except for a small amount of leakage flow that may escape between the stop surfaces 62' and the piston end surface 74' and then flow through the second vane stage 50*b*', exhaust gas can flow only through the first vane stage 50*a*' when the piston is closed.

In the open position of the piston 70', the upstream end surface 74' can be generally in axial alignment with the wall 43 of the turbine housing chamber, or can be somewhat upstream of or downstream of the wall 43. When the piston is axially slid in the downstream direction starting from the closed position, the end surface 74' of the piston separates from the stop surfaces 62' of the stepped vanes, and accordingly exhaust gas begins to flow through the unblocked portion of the second vane stage 50*b*'. With further travel of the piston, more and more of the second vane stage is unblocked so that a greater and greater proportion of the total exhaust gas flow passes through the second vane stage. When the piston reaches the open (i.e., fully open) position (FIG. 7), preferably most or all of the length of the second vane stage is unblocked.

FIGS. 9 through 12 show a turbine assembly 120 of a turbocharger in accordance with a third embodiment of the invention. The turbine assembly is generally similar to those of the first and second embodiments described above. The turbine assembly includes a turbine housing 38 having a chamber 42 and defining a bore 44, and includes a heat shield 46 having vanes 50 that include a step 60 in the vane outer surfaces defining stop surfaces 62 as in the first embodiment. The variable nozzle mechanism includes a carrier 80 as in the second embodiment above. The primary differences of the third embodiment compared to the first and second embodiments reside in the piston 170 that slides within the carrier 80. The piston 170 at its upstream end defines recesses 176 in the radially outer surface of the piston for receiving the second vane stages 50*b* of the vanes. The recesses extend only partially through the radial thickness of the piston wall, such that each recess has a bottom surface that faces the inner surface 54 of the respective vane received in the recess. The engagement of the vanes in the recesses tends to prevent the piston from rotating about its axis, and also helps to improve the sealing between the piston and the second vane stages so that exhaust gas is deterred from leaking between these parts. The recesses advantageously have an axial length corresponding to that of the second vane stage 50*b* and terminate at an end wall 178 of each recess. The free ends of the vanes abut the recess end walls 178 when the piston is in its closed position; in this position, the end surface 174 of the piston is axially aligned with the steps 60 in the vanes, and hence the piston blocks the entire second vane stage 50*b* such that exhaust gas flows only through the first vane stage 50*a* to the turbine wheel. As the piston is slid axially downstream, a gap begins to open up between the end surface of the piston and the steps 60 so that exhaust gas begins to flow through the unblocked portion of the second vane stage. When the piston reaches the open position, preferably the entire length of the second vane stage is unblocked.

Figure 13:
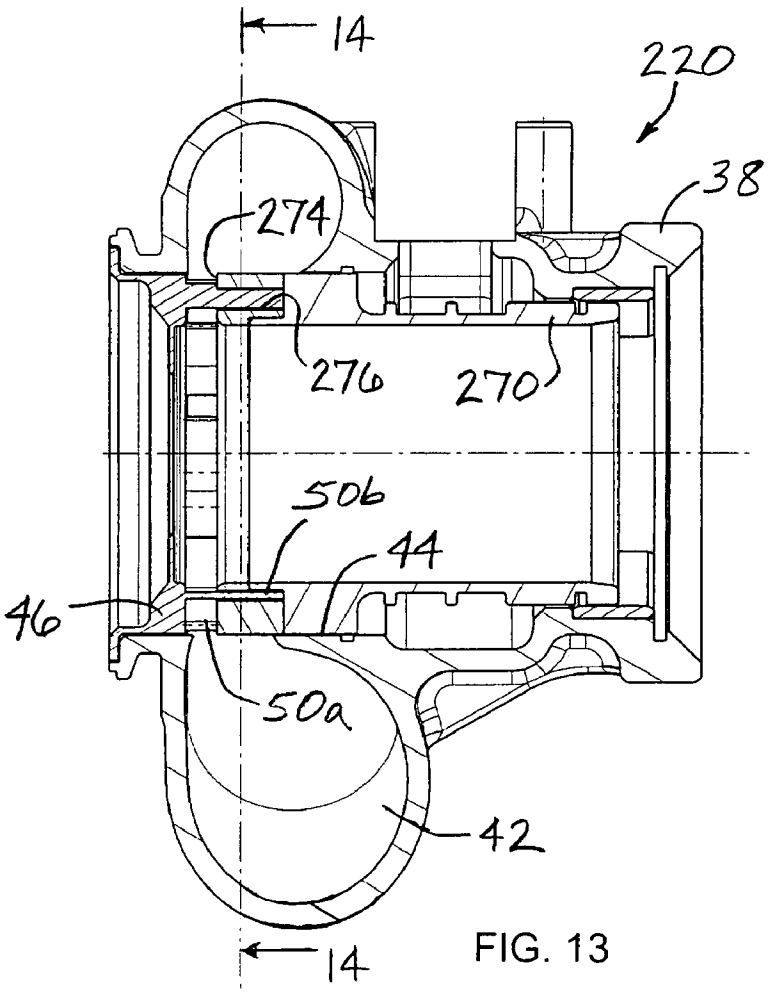
FIG. 13 is a cross-sectional view of a turbine assembly for a turbocharger, in accordance with a fourth embodiment of the invention, showing the piston in a closed position.
Figure 14:
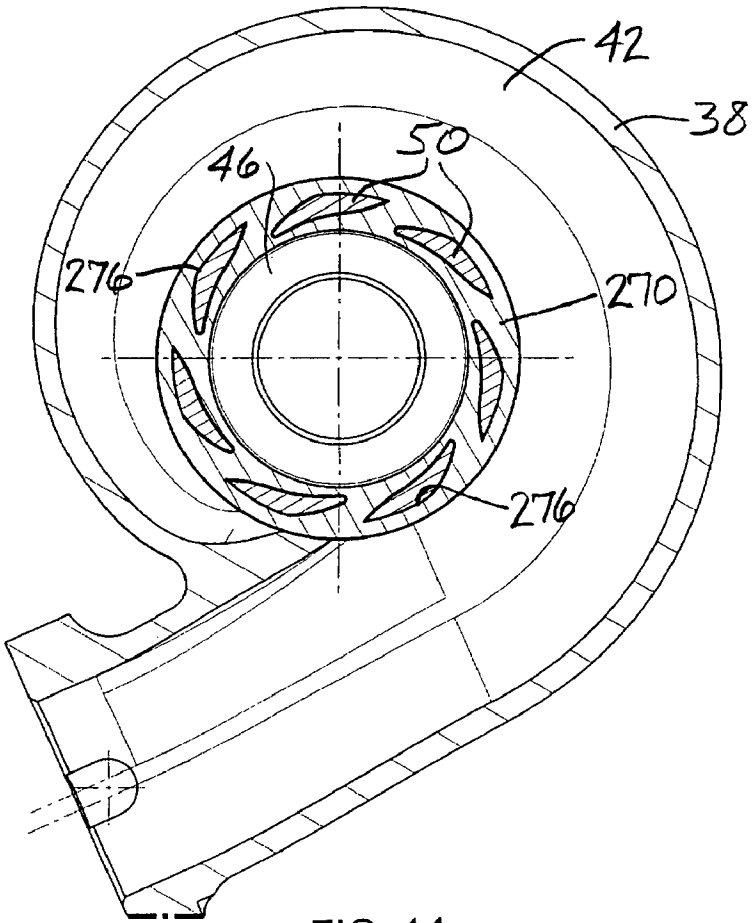
FIG. 14 is a cross-sectional view along line 14-14 of FIG. 13.

FIGS. 13 and 14 illustrate a turbine assembly 220 of a turbocharger in accordance with a fourth embodiment of the invention. The turbine portion is generally similar to that of the third described above. The turbine portion includes a turbine housing 38 having a chamber 42 and defining a bore 44, and includes a heat shield 46 having vanes 50 that include a step 60 in the vane outer surfaces defining stop surfaces 62 just as in the third embodiment. The primary differences of the fourth embodiment compared to the third embodiment reside in the piston 270 that slides within the turbine housing bore 44. The piston 270 at its upstream end has a greater radial wall thickness than in the third embodiment, and defines slots 276 that extend axially into the piston from the upstream end surface 274 for receiving the second vane stages 50*b* of the vanes. The engagement of the vanes in the slots tends to prevent the piston from rotating about its axis and helps provide sealing between the piston and vanes. The slots advantageously have an axial length at least as great as, and preferably substantially equal to, that of the second vane stage 50*b*. The end surface 274 of the piston abuts the vane stop surfaces 62 when the piston is in its closed position; in this position, the piston blocks the entire second vane stage 50*b* such that exhaust gas flows only through the first vane stage 50*a* to the turbine wheel. As the piston is slid axially downstream, a gap begins to open up between the end surface of the piston and the stop surfaces 62 so that exhaust gas begins to flow through the unblocked portion of the second vane stage. When the piston reaches the open position, preferably the entire length of the second vane stage is unblocked.

Figure 16:
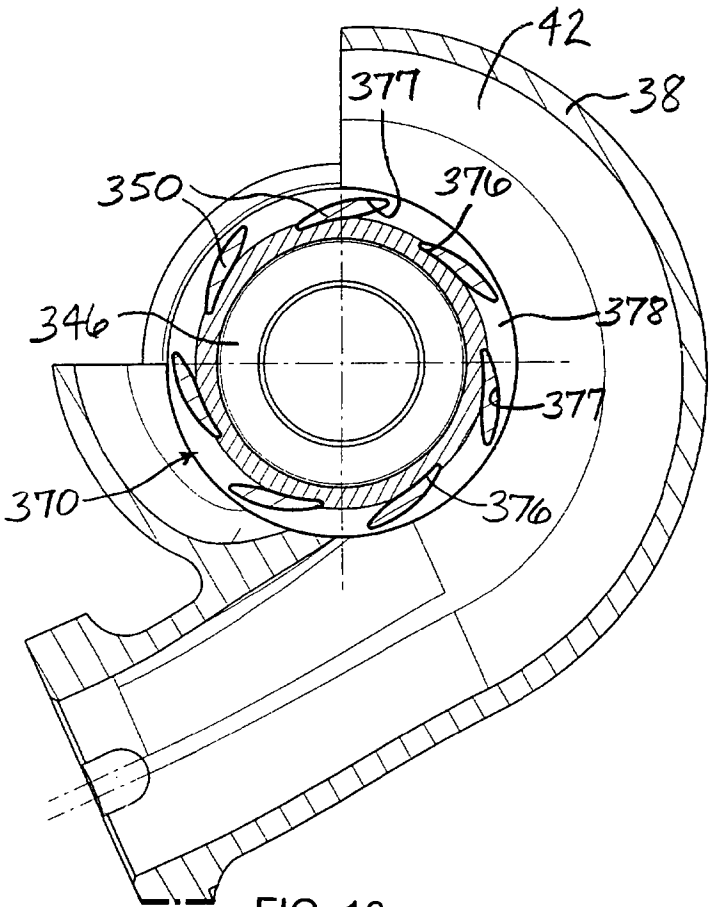
FIG. 16 is a cross-sectional view along line 16-16 of FIG. 15.
Figure 15:
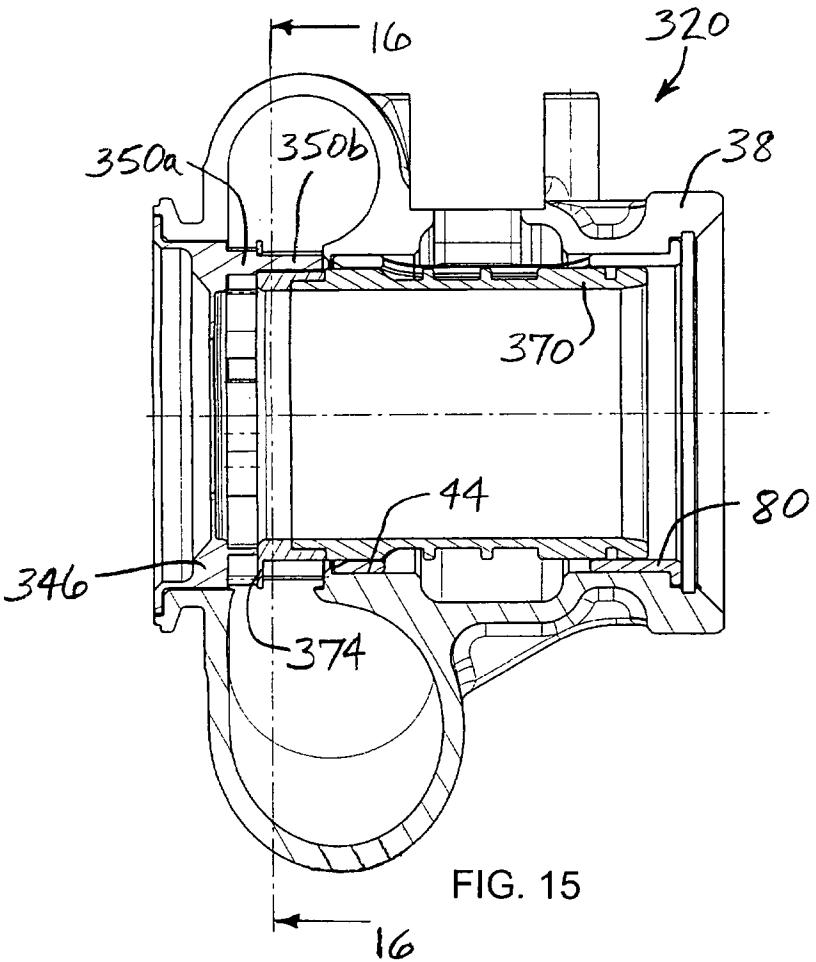
FIG. 15 is a cross-sectional view of a turbine assembly for a turbocharger, in accordance with a fifth embodiment of the invention, showing the piston in a closed position.

FIGS. 15 and 16 depict a turbine assembly 320 of a turbocharger in accordance with a fifth embodiment of the invention. This embodiment is generally similar to the third embodiment described above. The turbine assembly includes a turbine housing 38 having a chamber 42 and defining a bore 44. The turbine portion also includes a heat shield 346 having vanes 350, but unlike the third embodiment, the vanes include a step in both their outer surfaces and their inner surfaces, defining stop surfaces and dividing the vanes into first vane stages 350*a* and second vane stages 350*b*. The variable nozzle mechanism includes a carrier 80 and the piston 370 slides within the carrier as in the second embodiment above. The piston 370 at its upstream end has a radially outwardly extending flange 378. The flange defines apertures 377 for receiving the second vane stages 350*b* of the vanes. The radially outer surface of the piston just downstream of the flange 378 also defines recesses 376 for receiving the second vane stages, similar to the recesses 176 of the third embodiment described above. The engagement of the vanes in the apertures 377 of the flange and in the recesses 376 tends to prevent the piston from rotating about its axis and helps provide sealing between the piston and vanes. The flange 378 abuts the vane stop surfaces when the piston is in its closed position as shown in FIG. 15; in this position, the end surface 174 of the piston flange is axially aligned with the steps 360 in the vanes, and hence the piston blocks the entire second vane stage 350*b* such that exhaust gas flows only through the first vane stage 350*a* to the turbine wheel. As the piston is slid axially downstream, a gap begins to open up between the end surface of the piston and the steps 360 so that exhaust gas begins to flow through the unblocked portion of the second vane stage. When the piston reaches the open position, preferably the entire length of the second vane stage is unblocked.

Figure 18:
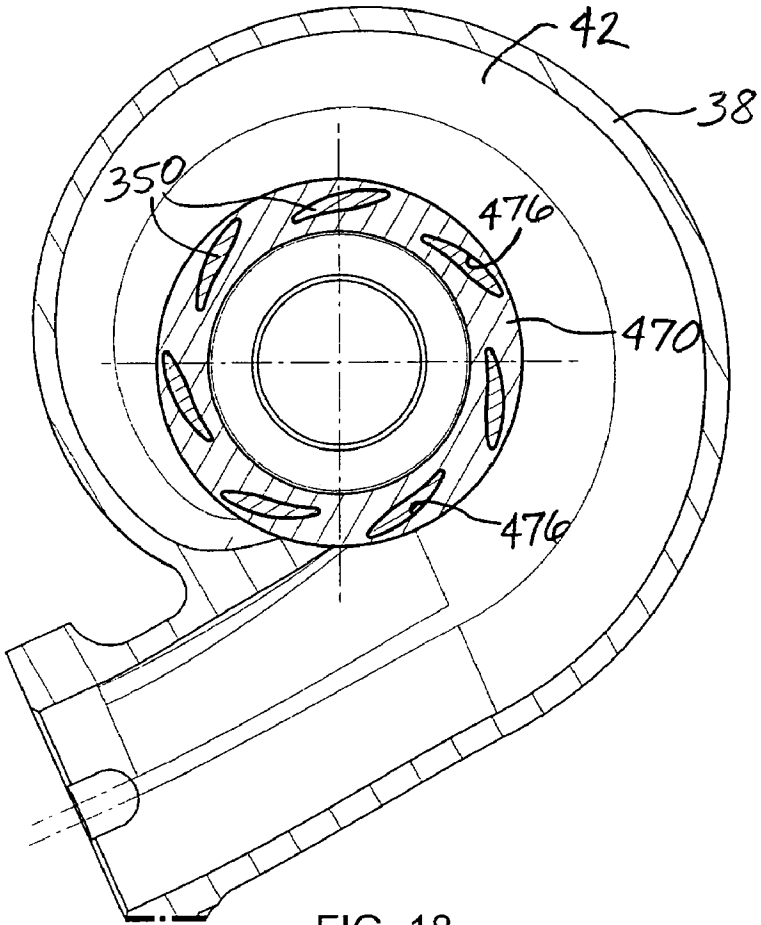
FIG. 18 is a cross-sectional view along line 18-18 of FIG. 17.
Figure 17:
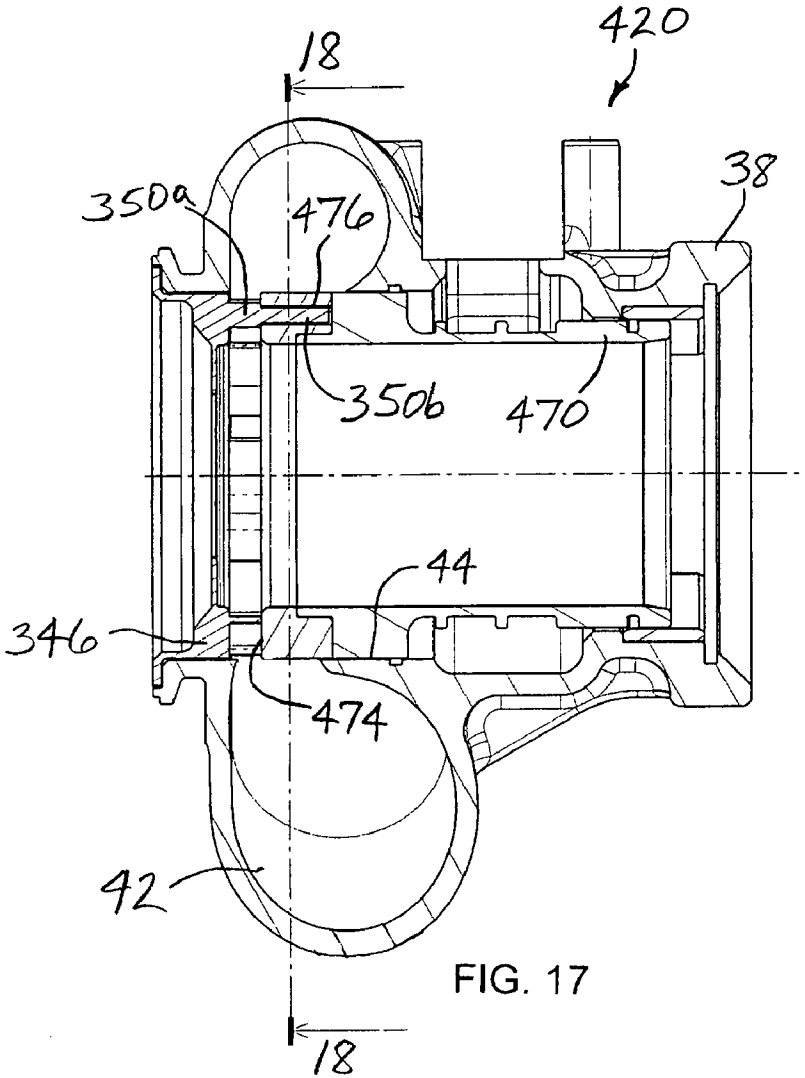
FIG. 17 is a cross-sectional view of a turbine assembly for a turbocharger, in accordance with a sixth embodiment of the invention, showing the piston in a closed position.

FIGS. 17 and 18 show a sixth embodiment of the invention. The turbine assembly 420 in accordance with this embodiment has a heat shield 346 supporting vanes 350 substantially identical to those of the fifth embodiment above. The turbine portion includes a piston 470 that slides in the bore 44.*of* the turbine housing 38. The piston 470 is substantially similar to the piston 270 of the fourth embodiment. Thus, the piston 470 at its upstream end has a substantial radial wall thickness and defines slots 476 that extend axially into the piston from the upstream end surface 474 for receiving the second vane stages 350*b* of the vanes. The engagement of the vanes in the slots tends to prevent the piston from rotating about its axis and helps provide sealing between the piston and vanes. The slots advantageously have an axial length at least as great as, and preferably substantially equal to, that of the second vane stage 350*b*. The end surface 474 of the piston abuts the vane stop surfaces when the piston is in its closed position; in this position, the piston blocks the entire second vane stage 350*b* such that exhaust gas flows only through the first vane stage 350*a* to the turbine wheel. As the piston is slid axially downstream, a gap begins to open up between the end surface of the piston and the stop surfaces so that exhaust gas begins to flow through the unblocked portion of the second vane stage. When the piston reaches the open (i.e., fully open) position, preferably most or all of the length of the second vane stage is unblocked.

In the various embodiments of the invention, in order to avoid binding between the piston and the second stage vanes at high temperature, a small gap is intentionally provided between the second stage vane outer surface(s) and corresponding any surface(s) of the piston confronted thereby. As described, the first stage vanes have a "thicker" profile than the second stage vanes, thus creating the so-called "step". The step serves two functions: (1) it seals up the gap between the piston and second stage vanes when the piston is fully closed, and (2) it ensures a reliable mechanical stop for the sliding piston in the fully closed position.

Many modifications and other embodiments of the inventions set forth herein will come to mind to one skilled in the art to which these inventions pertain having the benefit of the teachings presented in the foregoing descriptions and the associated drawings. For example, the stepped vanes in the illustrated and described embodiments are affixed to a heat shield, but alternatively the turbocharger can be designed such that the vanes are affixed to a wall of the center housing or are affixed in some other way. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbine assembly for a turbocharger, comprising:

a turbine housing defining a bore and defining a chamber surrounding the bore for receiving exhaust gas to be directed into a turbine wheel disposed in the bore, a radially inner side of the chamber having an axial length; and a variable nozzle having stepped two-stage vanes, the variable nozzle comprising:

a tubular piston disposed in the bore of the turbine housing such that the piston is axially slidable relative to the turbine housing along the radially inner side of the chamber such that the piston blocks a variable portion of the axial length of the chamber depending on axial position of the piston, the piston having an upstream end and a downstream end with respect to a flow direction of exhaust gas along the bore of the turbine housing; and a generally annular wall that extends generally radially inwardly adjacent an upstream end of the axial length of the chamber, and an array of circumferentially spaced vanes having fixed ends joined to the generally annular wall and opposite free ends, the vanes extending across the axial length of the chamber, the vanes each having an outer surface that faces generally radially outwardly and an opposite inner surface that faces generally radially inwardly, wherein each vane defines a first vane stage proximate the fixed end of the vane and a second vane stage proximate the free end of the vane, wherein the first vane stage is contoured to guide the exhaust gas to exit the first vane stage with a first flow angle, and the second vane stage is contoured to guide the exhaust gas to exit the second vane stage with a second flow angle different from the first flow angle, each vane comprising a step transitioning from the first vane stage to the second vane stage, and wherein the piston in a closed position closes the second vane stage so that exhaust gas flows only through the first vane stage, the second vane stage being progressively opened as the piston is axially slid toward an open position.

2. The turbine assembly of claim 1, wherein the step defines a downstream-facing surface that is abutted by the piston to define the closed position of the piston.

3. The turbine assembly of claim 1, wherein the step is in the outer surface of each vane, and the upstream end of the piston has a radially inner surface that travels adjacent to the outer surfaces of the second vane stages as the piston is axially slid.

4. The turbine assembly of claim 1, wherein the step is in the inner surface of each vane, and the upstream end of the piston has a radially outer surface that travels adjacent to the inner surfaces of the second vane stages as the piston is axially slid.

5. The turbine assembly of claim 1, wherein the upstream end of the piston has a radial wall thickness exceeding a radial extent of the second vane stages, the piston defining slots extending into the upstream end of the piston for receiving the second vane stages.

6. The turbine assembly of claim 5, wherein the step is in the outer surface of each vane.

7. The turbine assembly of claim 5, wherein the step is in both the outer and inner surfaces of the vanes.

8. The turbine assembly of claim 1, wherein the upstream end of the piston defines a radially outwardly extending flange, the flange defining apertures therethrough for receiving the second vane stages, and the flange abutting the step to define the closed position of the piston.

9. The turbine assembly of claim 8, wherein the step is in both the outer and inner surfaces of each vane.

10. The turbine assembly of claim 1, wherein the upstream end of the piston has a radial wall thickness exceeding a radial extent of the second vane stages, the piston defining slots extending into the upstream end of the piston for receiving the second vane stages, and wherein the step is in both the outer and inner surfaces of the vanes.

11. The turbine assembly of claim 1, wherein the generally annular wall to which the vanes are affixed comprises a heat shield.

12. A turbine assembly for a turbocharger, comprising:

a turbine housing defining a bore and defining a chamber surrounding the bore for receiving exhaust gas to be directed into a turbine wheel disposed in the bore, a radially inner side of the chamber having an axial length; and a variable nozzle having stepped two-stage vanes, the variable nozzle comprising:

a tubular piston disposed in the bore of the turbine housing such that the piston is axially slidable relative to the turbine housing along the radially inner side of the chamber such that the piston blocks a variable portion of the axial length of the chamber depending on axial position of the piston, the piston having an upstream end and a downstream end with respect to a flow direction of exhaust gas along the bore of the turbine housing; and a generally annular wall that extends generally radially inwardly adjacent an upstream end of the axial length of the chamber, and an array of circumferentially spaced vanes having fixed ends joined to the generally annular wall and opposite free ends, the vanes extending across the axial length of the chamber, the vanes each having an outer surface that faces generally radially outwardly and an opposite inner surface that faces generally radially inwardly, wherein each vane defines a first vane stage proximate the fixed end of the vane and a second vane stage proximate the free end of the vane, each vane comprising a step transitioning from the first vane stage to the second vane stage, and wherein the piston in a closed position closes the second vane stage so that exhaust gas flows only through the first vane stage, the second vane stage being progressively opened as the piston is axially slid toward an open position, wherein the step is in the outer surface of each vane, and the upstream end of the piston has a radially outer surface in which recesses are formed for respectively receiving the second vane stages with the inner surface of each second vane stage confronting a radially outwardly facing wall of each respective recess, and wherein the free ends of the vanes abut end walls of the recesses to define the closed position of the piston.

13. A turbine assembly for a turbocharger, comprising:

a turbine housing defining a bore and defining a chamber surrounding the bore for receiving exhaust gas to be directed into a turbine wheel disposed in the bore, a radially inner side of the chamber having an axial length; and a variable nozzle having stepped two-stage vanes, the variable nozzle comprising:

a tubular piston disposed in the bore of the turbine housing such that the piston is axially slidable relative to the turbine housing along the radially inner side of the chamber such that the piston blocks a variable portion of the axial length of the chamber depending on axial position of the piston, the piston having an upstream end and a downstream end with respect to a flow direction of exhaust gas along the bore of the turbine housing; and a generally annular wall that extends generally radially inwardly adjacent an upstream end of the axial length of the chamber, and an array of circumferentially spaced vanes having fixed ends joined to the generally annular wall and opposite free ends, the vanes extending across the axial length of the chamber, the vanes each having an outer surface that faces generally radially outwardly and an opposite inner surface that faces generally radially inwardly, wherein each vane defines a first vane stage proximate the fixed end of the vane and a second vane stage proximate the free end of the vane, each vane comprising a step transitioning from the first vane stage to the second vane stage, and wherein the piston in a closed position closes the second vane stage so that exhaust gas flows only through the first vane stage, the second vane stage being progressively opened as the piston is axially slid toward an open position, further comprising a tubular carrier inserted into the bore of the turbine housing, the piston being received within the carrier and being axially slidable relative to the carrier, wherein the carrier is axially split such that the carrier is able to radially expand and contract as the piston expands and contracts.

* * * * *